US009038999B2

(12) United States Patent
Kiridena et al.

(10) Patent No.: US 9,038,999 B2
(45) Date of Patent: May 26, 2015

(54) FIXTURE ASSEMBLY FOR FORMING PROTOTYPE PARTS ON AN INCREMENTAL FORMING MACHINE

(75) Inventors: Vijitha Senaka Kiridena, Ann Arbor, MI (US); Zhiyong Cedric Xia, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 167 days.

(21) Appl. No.: 13/572,031

(22) Filed: Aug. 10, 2012

(65) Prior Publication Data

US 2014/0042683 A1 Feb. 13, 2014

(51) Int. Cl.

| | |
|---|---|
| ***B23Q 3/00*** | (2006.01) |
| ***B25B 1/20*** | (2006.01) |
| ***B25B 1/06*** | (2006.01) |
| ***E04H 15/36*** | (2006.01) |
| ***E04H 15/34*** | (2006.01) |
| ***E04C 2/42*** | (2006.01) |
| ***B21D 31/00*** | (2006.01) |
| ***B21D 43/00*** | (2006.01) |
| *B23Q 1/26* | (2006.01) |

(52) U.S. Cl.

CPC ..... *B21D 31/005* (2013.01); *Y10T 29/49959* (2013.01); *B21D 43/003* (2013.01)

(58) Field of Classification Search

USPC ..... 269/287, 225, 164, 40, 305; 135/133, 135/157, 124; 52/270, 666, 665, 13, 143, 52/606

See application file for complete search history.

(56) References Cited

U.S. PATENT DOCUMENTS

| | | | | | |
|---|---|---|---|---|---|
| 3,188,078 | A | * | 6/1965 | Peterson | 269/305 |
| 3,424,178 | A | * | 1/1969 | Yazaki | 135/157 |
| 3,683,581 | A | * | 8/1972 | Yamaso | 52/666 |
| 4,140,415 | A | * | 2/1979 | Koyamato | 403/104 |
| 4,175,686 | A | * | 11/1979 | Lang | 225/97 |
| 4,539,738 | A | * | 9/1985 | Antol et al. | 29/467 |
| 4,565,358 | A | * | 1/1986 | Hosoi et al. | 269/60 |
| 4,583,848 | A | * | 4/1986 | Durbin | 355/67 |
| 4,636,606 | A | * | 1/1987 | Chastanet et al. | 219/121.63 |
| 4,711,436 | A | * | 12/1987 | Kobuck et al. | 269/40 |
| 4,716,919 | A | * | 1/1988 | Griffin | 135/133 |

(Continued)

FOREIGN PATENT DOCUMENTS

| | | | | |
|---|---|---|---|---|
| DE | 3302418 A1 | * | 8/1984 | B21D 43/20 |
| DE | 102004051994 B4 | * | 8/2006 | |

(Continued)

OTHER PUBLICATIONS

Ajay Yadav, Multipoint-Control Die Cushion Systems for Stamping Complex Parts, Stamping Journal, Sep. 2006, pp. 32-33.

(Continued)

*Primary Examiner* — Lee D Wilson
*Assistant Examiner* — Alvin Grant
(74) *Attorney, Agent, or Firm* — Damian Porcari; Brooks Kushman P.C.

(57) ABSTRACT

An incremental forming machine binder is provided that has a blank holding opening that may be subdivided into smaller blank holding openings. The opening is subdivided by one or more clamping modules that are connected by connecting modules to each other and the frame. Clamps are attached to the clamping modules to clamp blanks in the blank holding openings. Multiple blanks may be secured to the binder for incremental forming.

9 Claims, 4 Drawing Sheets

(56) References Cited

U.S. PATENT DOCUMENTS

| | | | | |
|---|---|---|---|---|
| 4,723,388 | A * | 2/1988 | Zieg | 52/665 |
| 4,813,734 | A * | 3/1989 | Hoover | 296/100.17 |
| 5,029,853 | A * | 7/1991 | Cunningham | 473/459 |
| 5,104,609 | A * | 4/1992 | Okuyama et al. | 376/261 |
| 5,180,126 | A * | 1/1993 | Bennett | 248/99 |
| 5,188,798 | A * | 2/1993 | Okuyama et al. | 376/442 |
| 5,305,708 | A * | 4/1994 | Keisler, Jr. | 119/462 |
| 5,370,368 | A * | 12/1994 | Terrels et al. | 256/19 |
| 5,377,711 | A * | 1/1995 | Mueller | 135/87 |
| 5,414,950 | A * | 5/1995 | Johnson, Sr. | 43/1 |
| 5,443,532 | A * | 8/1995 | Hudak | 5/652 |
| 5,490,419 | A * | 2/1996 | Webb | 73/40.5 R |
| 5,526,614 | A * | 6/1996 | Huang | 52/13 |
| 5,548,895 | A * | 8/1996 | Grenci et al. | 29/890.141 |
| 5,586,767 | A * | 12/1996 | Bohland | 273/349 |
| 5,595,203 | A * | 1/1997 | Espinosa | 135/124 |
| 5,702,079 | A * | 12/1997 | MacLaren | 248/127 |
| 5,772,537 | A * | 6/1998 | Anderson et al. | 473/435 |
| 5,810,233 | A * | 9/1998 | Varidel | 225/97 |
| 5,901,599 | A | 5/1999 | Sato et al. | |
| 5,927,311 | A * | 7/1999 | Jager | 135/124 |
| 5,970,672 | A * | 10/1999 | Robinson | 52/270 |
| 6,009,787 | A * | 1/2000 | Hanggi | 83/688 |
| 6,185,476 | B1 * | 2/2001 | Sakai | 700/182 |
| 6,209,240 | B1 * | 4/2001 | Engle | 38/102.91 |
| 6,231,038 | B1 * | 5/2001 | Keyser et al. | 269/287 |
| 6,247,268 | B1 * | 6/2001 | Auer | 47/62 R |
| 6,463,705 | B1 * | 10/2002 | Davis et al. | 52/143 |
| 6,467,424 | B1 * | 10/2002 | Yates et al. | 114/312 |
| 6,523,322 | B1 * | 2/2003 | Michalski et al. | 52/745.05 |
| 6,745,414 | B2 * | 6/2004 | Zhou | 4/599 |
| 6,997,364 | B2 * | 2/2006 | Oetlinger | 225/104 |
| 7,125,351 | B1 * | 10/2006 | Raber | 473/478 |
| 7,128,463 | B2 * | 10/2006 | Hong | 366/53 |
| 7,172,184 | B2 * | 2/2007 | Pavani et al. | 269/37 |
| 7,222,825 | B2 * | 5/2007 | Gilbert | 248/95 |
| 7,257,460 | B2 | 8/2007 | Venugopal et al. | |
| 7,356,857 | B2 * | 4/2008 | Rosenberg | 4/601 |
| 7,467,469 | B2 * | 12/2008 | Wall | 29/897 |
| 7,536,892 | B2 | 5/2009 | Amino et al. | |
| 7,588,644 | B1 * | 9/2009 | Olivier | 134/10 |
| 7,894,920 | B2 * | 2/2011 | Mifsud et al. | 700/95 |
| 8,072,453 | B2 * | 12/2011 | Kling | 345/423 |
| 8,109,539 | B2 * | 2/2012 | Krohn | 285/322 |
| 8,323,163 | B2 * | 12/2012 | Asai | 493/58 |
| 8,454,005 | B2 * | 6/2013 | Cheng | 269/287 |
| 8,474,359 | B2 * | 7/2013 | George | 83/745 |
| 8,678,365 | B2 * | 3/2014 | Hofmann et al. | 269/287 |
| 8,721,467 | B1 * | 5/2014 | Ackerman | 473/257 |
| 2003/0230038 | A1 * | 12/2003 | Seavy | 52/270 |
| 2004/0103601 | A1 * | 6/2004 | Bergqvist | 52/284 |
| 2004/0258513 | A1 * | 12/2004 | Cooke | 414/626 |
| 2005/0210762 | A1 * | 9/2005 | Broberg | 52/79.1 |
| 2006/0191232 | A1 * | 8/2006 | Salazar et al. | 52/606 |
| 2009/0206536 | A1 * | 8/2009 | Saitta | 269/164 |
| 2010/0199742 | A1 | 8/2010 | Johnson et al. | |
| 2010/0300547 | A1 * | 12/2010 | Nomoto et al. | 137/1 |
| 2012/0011915 | A1 | 1/2012 | Kiridena et al. | |
| 2012/0018940 | A1 * | 1/2012 | Kumnig et al. | 269/225 |
| 2012/0024034 | A1 | 2/2012 | Ren et al. | |
| 2012/0024035 | A1 | 2/2012 | Kiridena et al. | |

FOREIGN PATENT DOCUMENTS

| | | | | |
|---|---|---|---|---|
| EP | 1462189 | A1 * | 9/2004 | B21D 22/14 |
| EP | 1462190 | A1 * | 9/2004 | B21D 22/14 |
| WO | 2011106869 | | 9/2011 | |

OTHER PUBLICATIONS

Bahattin Koc et al., Design and Analysis of a Reconfigurable Discrete Pin Tooling System for Molding of Three Dimensional Free-Form Objects, Jul. 2010, pp. 1-14.

* cited by examiner

FIXTURE ASSEMBLY FOR FORMING PROTOTYPE PARTS ON AN INCREMENTAL FORMING MACHINE

TECHNICAL FIELD

The present invention relates to a fixture assembly for an incremental forming machine and a method for configuring the fixture assembly.

BACKGROUND

One process for forming a sheet metal prototype part, manufacturing low volumes of sheet metal components, or custom sheet metal parts is to build a low production die set for a stamping machine. This process is time consuming and expensive. The die set needs to be built and is limited to forming a specific part.

Incremental forming is a process used for forming sheet metal prototypes, manufacturing low volumes of sheet metal components, or custom sheet metal. An incremental forming machine can be used to form a prototype part by using one or more stylus tools that follow CAD data to form the sheet metal in increments into a prototype part. Incremental forming offers the advantages of low cost, reduced time between design freeze and delivery of prototype parts, and reduced energy consumption. One problem with incremental forming is that even for a small part the blank used must fill the entire binder. This may create excessive scrap and also affect part dimensional accuracy or to sacrifice cycle time to achieve tight dimensional accuracy when making small prototypes. Incremental forming productivity is reduced because the stylus tools can only form one prototype part per fixture set-up. A new blank must be loaded in the binder of the incremental forming machine to make each additional part.

This disclosure is directed to the above problems and other problems as summarized below.

SUMMARY

According to one aspect of the disclosure, an incremental forming machine is provided that has a binder opening that can be divided into smaller portions to allow a smaller blank to be formed. This reduces the amount of scrap produced by the incremental forming process. Clamp supporting segments are used to support clamps that secure multiple blanks in the binder. This eliminates the need to reload the binder with a new blank after forming each part. Multiple parts can be formed in separate areas on a single blank by simply entering CAD data for each of the parts. The present invention allows for different sized parts or multiple parts to be formed on different sized blanks in a single fixture set-up.

In one embodiment, a fixture assembly is provided for forming one or more smaller blanks The fixture assembly includes a frame that defines an opening and dividing members that extend across the opening. The dividing members include a plurality of clamp support segments and connecting members. The clamp support segments support a clamping mechanism to secure the smaller blanks in the larger opening. The clamp support segments are interconnected in the opening by the connecting members to provide a clamping mechanism about the blank periphery. The clamping mechanism can be manually, pneumatically, hydraulically, or electrically actuated. For structural support, a reinforcement rod is inserted through the clamp support segments and the connecting members. The reinforcement rods are fastened to the frame to ensure that the clamp support segments rigidly support the clamping mechanism during the forming process.

In another embodiment, a method is provided for configuring the fixture assembly. The fixture assembly is configured by framing an opening for a blank. The framed opening is divided into a plurality of sub-frames by assembling within the frame a plurality of clamp support segments, connecting members, and reinforcement rods. The clamp support segments may be mechanically connected to the frame and one or more clamp support segments by the connecting members. This allows for all sides of the blank to be secured during the forming process. The clamp support segments and the connecting members are reinforced by the reinforcement rods. The reinforcement rods support the clamp support segments and the connecting members to resist the forces applied by the stylus tools of the incremental forming machine on the blank. The reinforcement rods rigidly reinforce the clamp support segments and the connecting members. This method saves time and improves the efficiency of the incremental forming process by allowing blanks of various sizes to be formed without unloading and reloading the incremental forming machine.

According to another aspect of the disclosure, a reconfigurable fixture assembly is provided for an incremental forming fixture. In this embodiment, a binder has an opening that is divided by the clamp support segments to partition the opening. Smaller blanks may be supported by the fixture in the opening to reduce setup. Multiple blanks may be set in the fixture assembly at the same time. The clamp support segments partition the opening and are connected by a plurality of connecting members. The connecting members connect the clamp support segments that are disposed around a blank periphery. A clamping mechanism is provided on each of the clamp support segment to exert a clamping force on the blank. A reinforcement rod is attached to the clamp support segments, the connecting members, and the frame to support the blank within the binder opening.

The above aspects of the disclosure and other aspects will be better understood in view of the attached drawings and the following detailed description of the illustrated embodiments.

DETAILED DESCRIPTION

The illustrated embodiments are disclosed with reference to the drawings. It should be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but merely as a representative basis for teaching one skilled in the art how to practice the disclosed concepts.

Figure 1:
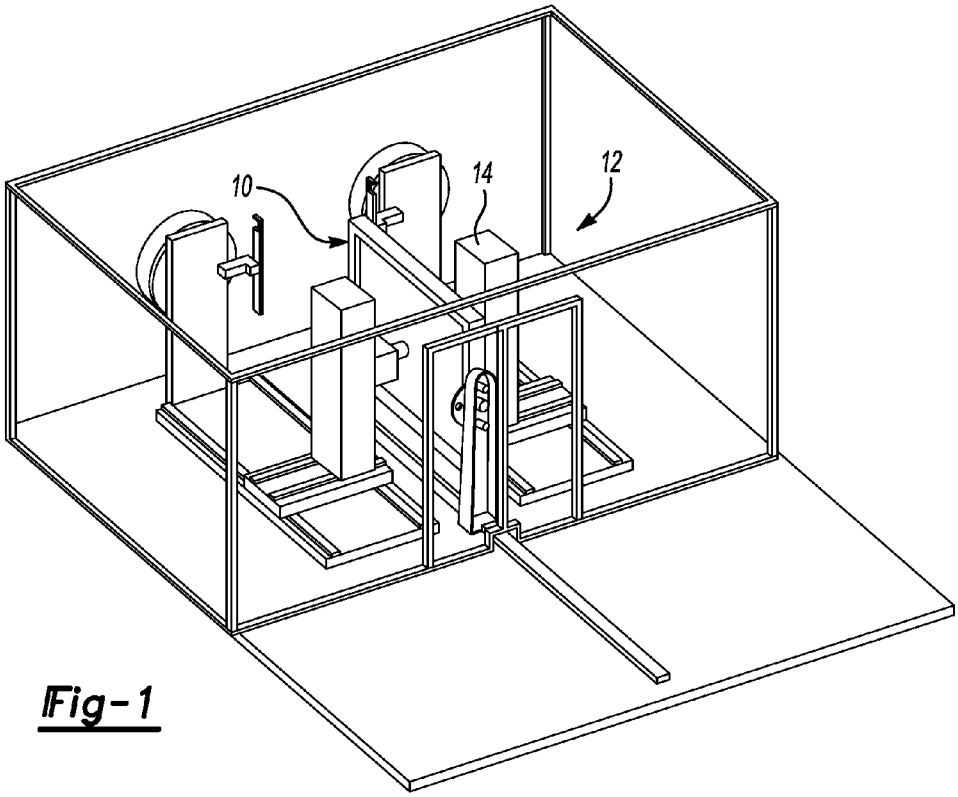
FIG. 1 is a perspective view of an incremental forming machine.

Referring to FIG. 1, a fixture assembly 10 is shown in an incremental forming machine 12. The fixture assembly 10 is in a vertical position to allow multiple degrees of freedom motion devices such as multi-axis CNC machines or robots 14 to form both sides of a blank 16 at the same time or sequentially.

Figure 2:
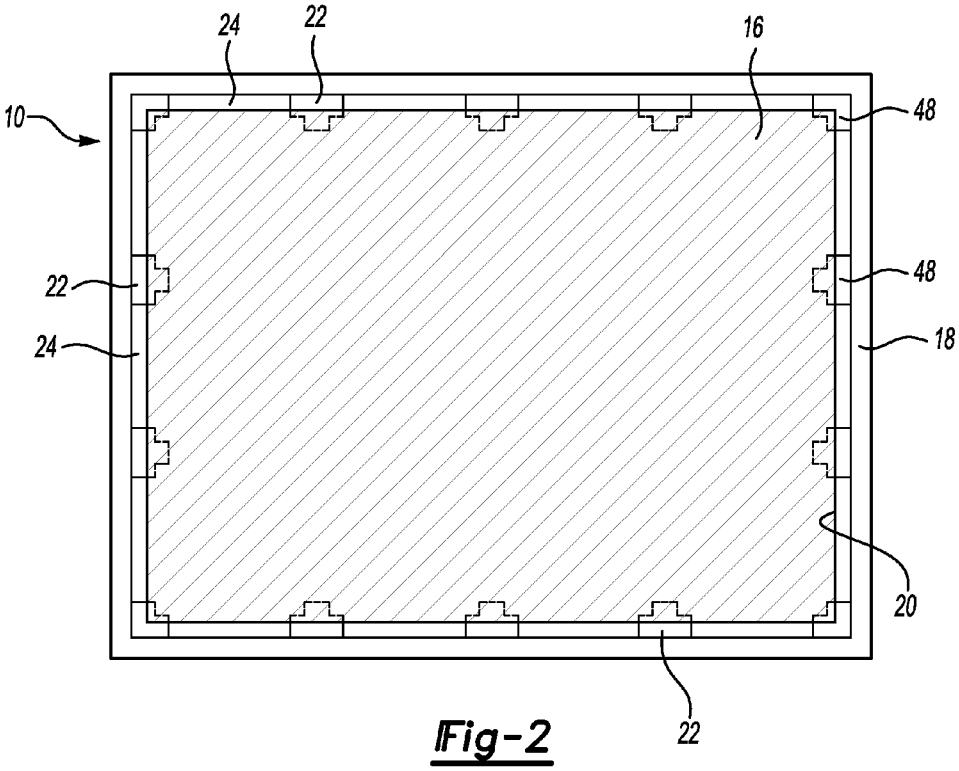
FIG. 2 is a top view showing the fixture assembly with a single blank.

FIG. 2 shows the fixture assembly 10 with a single blank 16 in a frame 18 that defines an opening 20. A plurality of connecting members 22 connects a plurality of clamp support segments 24 around the periphery of the blank 16'. The fixture assembly 10 is shown supporting the blank 16 that fills the entire opening 20.

Figure 3:
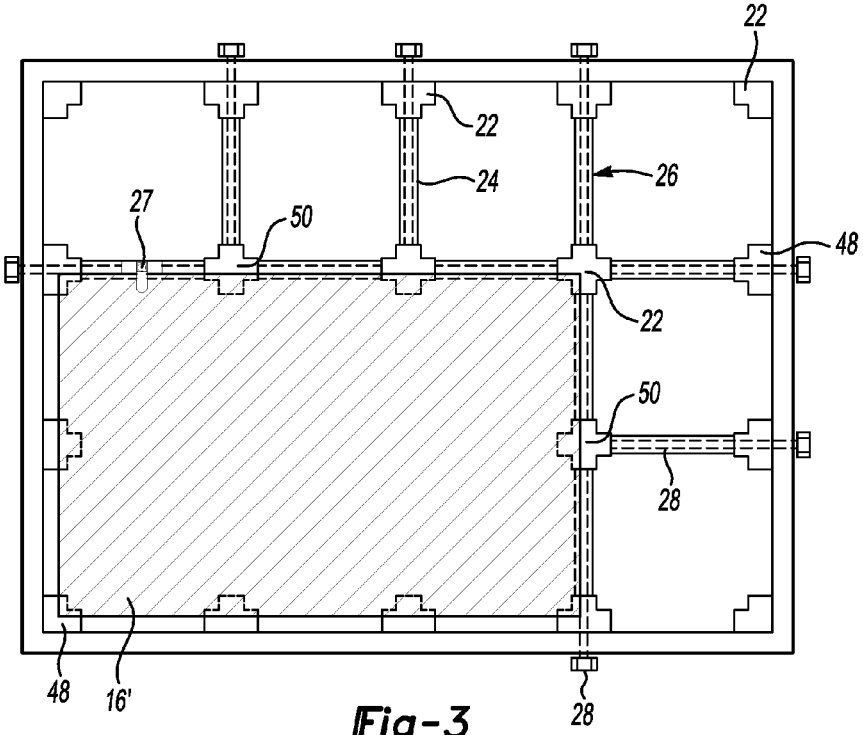
FIG. 3 is a top view showing the clamp support segments and the connecting members retaining a blank that is smaller than the defined opening.

FIG. 3 shows a sub-frame assembly 26 that comprises a plurality of connecting members 22, and clamp support segments 24. The clamp support segments 24 each may support a clamp 27 for clamping a smaller blank 16' within the sub-frame assembly 26. A plurality of reinforcement rods 28 extend through and support the connecting members 22 and the clamp support segments 24 that subdivide the opening 20 into a plurality of smaller openings 20'. The sub-frame assembly 26 is secured to the frame 14 to facilitate forming the smaller blank 16'.

Figure 4:
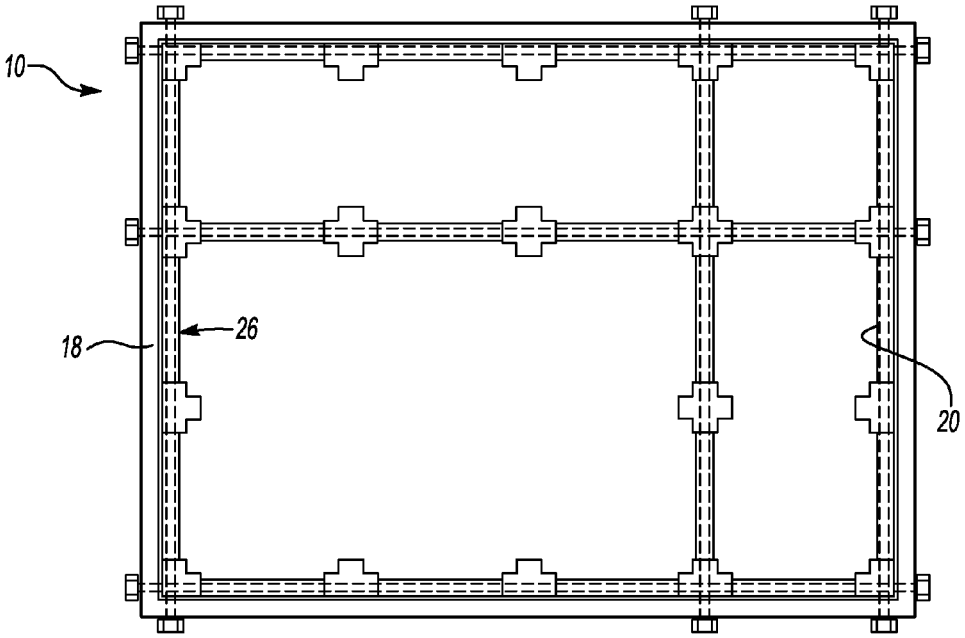
FIG. 4 is a top view of the fixture assembly showing the clamp support segments, the connecting members, and the reinforcement rod assembled to the fixture assembly.

FIG. 4 shows the fixture assembly 10 without the blank 16' in the smaller opening 20'. The sub-frame assembly 26 extends across the frame 18 to partition the opening 20 into smaller openings 20'. Several blanks 16' that have substantially different peripheries may be supported by the fixture assembly 10.

Figure 5:
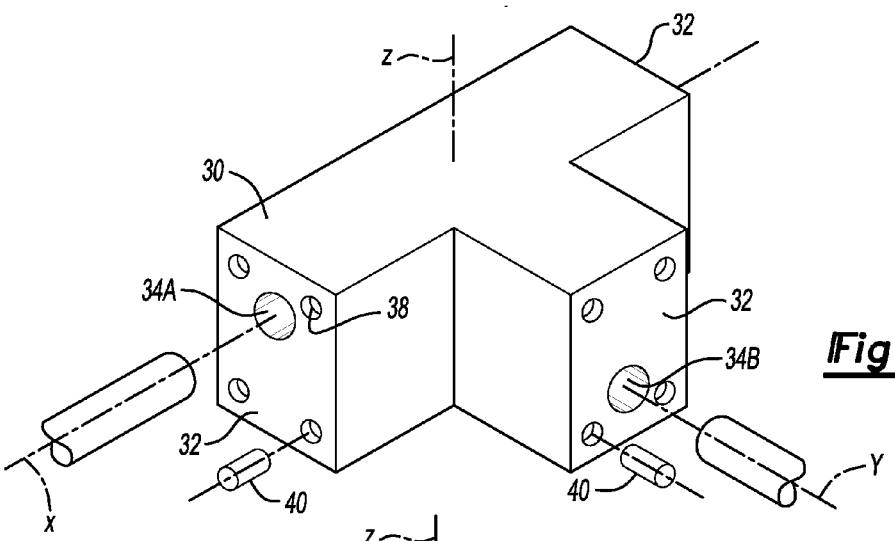
FIG. 5 is a perspective view of a T-shaped connecting member.

FIG. 5 shows a T-shaped border connecting member 30 that has three different connecting ends 32. The T-shaped connecting members 30 define two holes 34A and 34B that receive a reinforcement rod 28. Hole 34A extends along an X-axis. Hole 34B extends along a Y-axis that is perpendicular to the X-axis and are offset from each other in a Z-axis direction. Holes 34A and 34B are offset along the Z-axis so that the reinforcement rods 28 do not interfere with each other when assembled to the connecting members 30. The connecting ends 32 also include a plurality of alignment pin holes 38. The alignment pin holes 38 receive a plurality of alignment pins 40 to align the connecting members 30 and the clamp support segments 24 (shown in FIGS. 2-4 and 8). The connecting ends 32 of the connecting members 30 may each receive a clamp support segment 24 at each connecting end 32.

Figure 6:
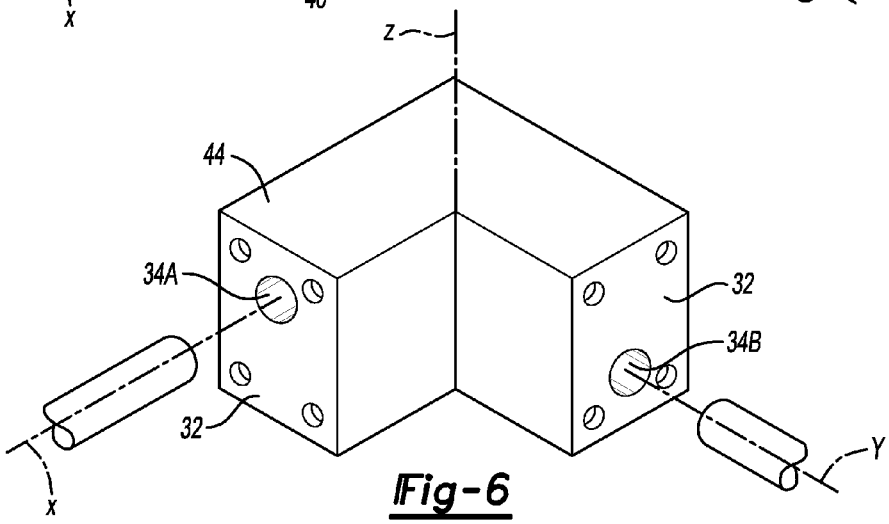
FIG. 6 is a perspective view of a corner connecting member.

FIG. 6 shows a corner connecting member 44 that has two connecting ends 32 and is adapted to receive two clamp support segments 24 (shown in FIGS. 2-4 and 8). The corner connecting member 44 may be used to join two clamp support segments 24 at two connecting ends 32. Similar to the T-shaped connecting member 30 shown in FIG. 5, the corner connecting member 44 also defines two holes 34A and 34B that extend along the X-axis and Y-axis directions. The holes are spaced apart along the Z-axis direction to ensure that the reinforcement rod 28 can extend through the connecting members without interference.

Figure 7:
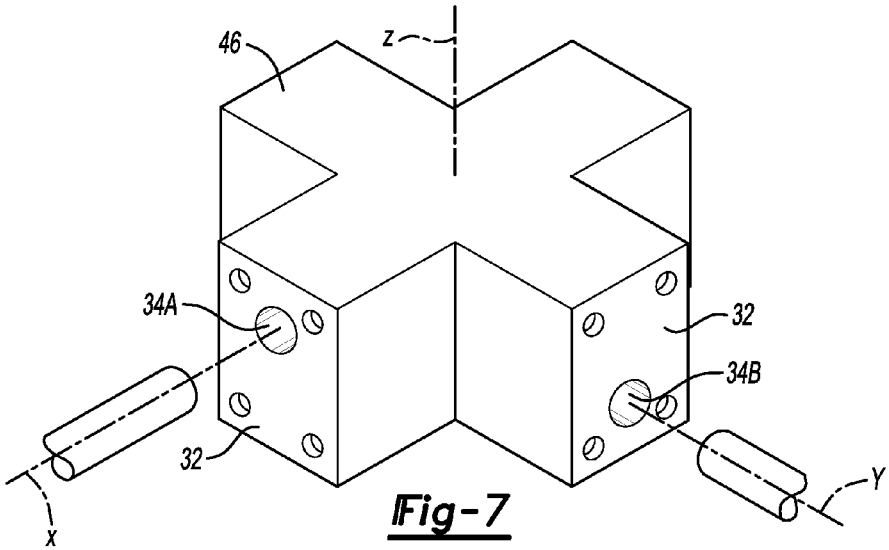
FIG. 7 is a perspective view of a cross connecting member.

FIG. 7 shows a cross connecting member 46 that has four connecting ends 32 for receiving up to four clamp support segments 24 (shown in FIGS. 2-4 and 8). The cross connecting member 46 has four connecting ends 32 that are each adapted to receive one of the clamp support segments 24. The cross connecting member 46 also has two receiving holes 34A and 34B that extend along the X-axis and Y-axis, respectively. The holes 34A and 34B are offset relative to each other in the Z-direction. The reinforcement rods 28 may be inserted through the connecting members 46 and the clamp support segments 24. The reinforcement rods 28 support the sub-frame assembly 26 and make the sub-frame assembly 26 more rigid.

Referring back to FIGS. 2-3, there are two distinct types of connecting members 22. The T-shaped border connecting member 30 and the corner connecting members 44 may also be known as edge connecting members 48. The edge connecting members 48 are disposed adjacent to the frame and allow the clamp support segments 24 to extend to the inner edge of the frame 18. While these connecting members 44 are typically placed at or near the frame 18, they can still be used within the opening 20. The term edge connecting member 48 refers to the edge of the blank 16', as these types of connecting members 48 are used to define support on all sides of the blank 16'. The cross connecting member 46 can also be used as an intermediate connecting member 50. The intermediate connecting members 50 are connecting members 22 that are disposed within the opening 20 at a distance from the frame (shown in FIG. 3). Intermediate connecting members 50 provide support in the space defined by the opening 20 (shown in FIG. 3). Despite having different classifications and types, all connecting members 22 share the same purpose. All of the connecting members 22 are used to link the clamp support segments 24 such that the blank 16' can be adequately supported on all sides.

Figure 8:
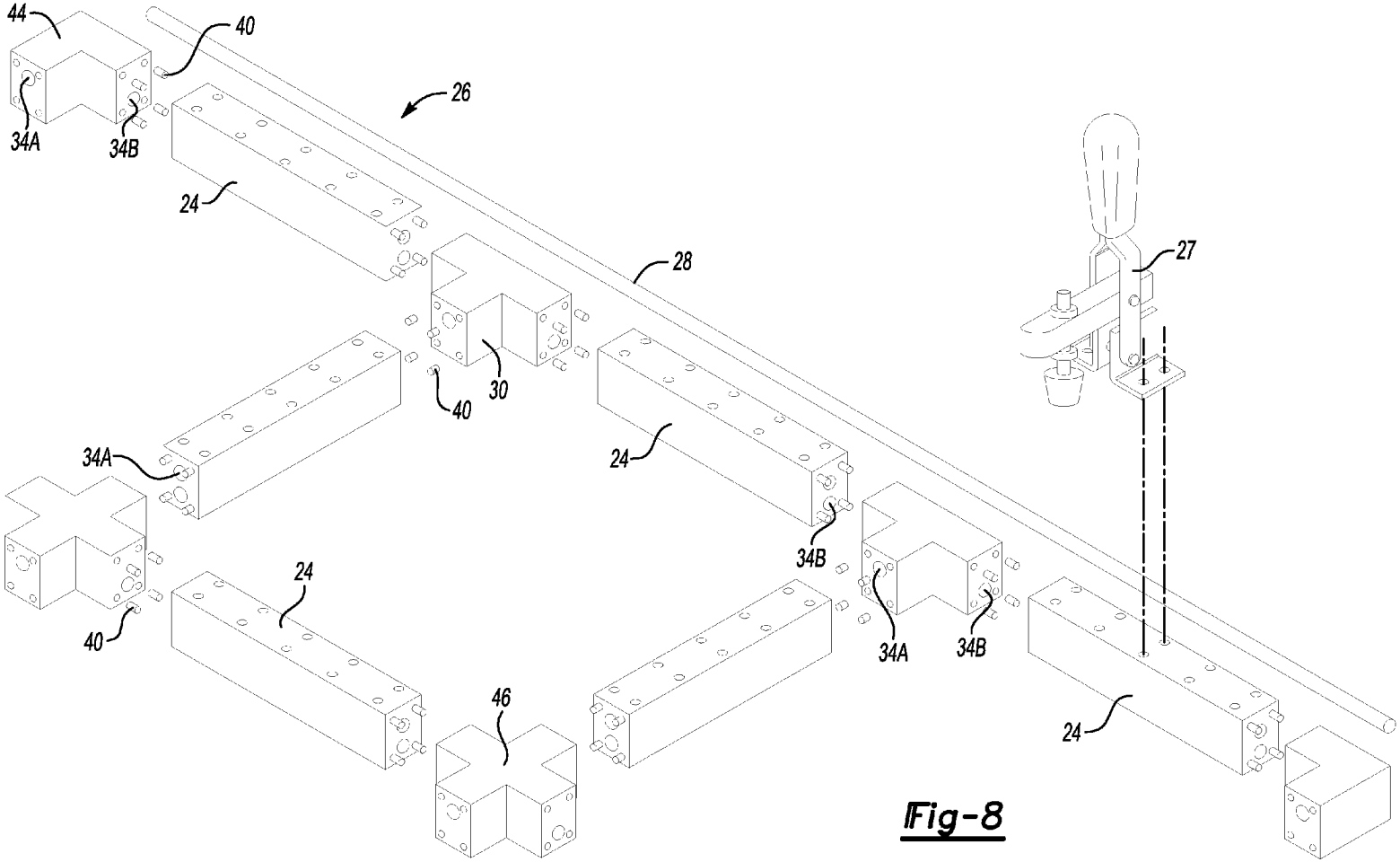
FIG. 8 is an exploded perspective view of parts of the fixture assembly showing the clamp support segments, the connecting members, and the reinforcement rod.

FIG. 8 is an exploded perspective view of the sub-frame assembly 26. The sub-frame assembly 26 may extend across the entire opening 20 (shown in FIGS. 2-4), or define a smaller opening 20 depending on the size of the blank 16'. The sub-frame assembly 26 may include several of the connecting members 30, 44 and 46, the reinforcement rods 28, the clamp support segments 24, and the alignment pins 40. The connecting members 30, 44 and 46 are aligned with the clamp support segments 24 by the alignment pins 40. The reinforcement rod 28 is inserted into the holes 34A and 34B that extend through the length of the sub-frame assembly 26 when the clamp support segments 24 are aligned and assembled with the connecting members 30, 44, and 46. The reinforcement rod 28 is then fastened to the frame 18 (shown in FIGS. 2-4) to support the clamps 27. Each clamp 27 is secured to one of the clamp support segments 24 to hold the blank 16' during the forming process.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A binder comprising:

a primary frame defining an opening;

a plurality of connecting members connectable to the primary frame having at least two connecting ends, a plurality of clamp support segments each connected to one of the connecting ends of one of the connecting members, and a reinforcement member extending through the connecting members and the clamp support segments to support at least one blank within a subdivided opening; and a plurality of alignment pins received on either a first end or a second end of the clamp support segments, wherein the alignment pins are received by the connecting ends of the connecting members.

2. The binder of claim 1 wherein the clamp support segments define at least two holes that extend from a first end through the second end of the clamp support segments, wherein the reinforcement member is inserted in one of the two holes.

3. The binder of claim 1 wherein the connecting members define a first hole that extends through a length of the connecting member and a second hole that extends through a width of the connecting member.

4. The binder of claim 1 further comprising a clamp disposed on the clamp support segments for securing the blank within the sub-divided openings.

5. A binder comprising:

a primary frame defining an opening; and a plurality of connecting members connectable to the primary frame having at least two connecting ends, a plurality of clamp support segments each connected to one of the connecting ends of one of the connecting members, the connecting members and the clamp support segments defining holes to which a reinforcement member is assembled to support at least one blank within a subdivided opening.

6. A binder comprising:

a primary frame defining an opening;

a plurality of connecting members connectable to the primary frame having at least two connecting ends, a plurality of clamp support segments each connected to one of the connecting ends of one of the connecting members, and a reinforcement member extending through the connecting members and the clamp support segments to support at least one blank within a subdivided opening; and a second reinforcement member is fastened to the primary fixture frame that extends perpendicular relative to the reinforcement member.

7. A fixture that holds a blank for an incremental forming machine, the fixture comprising:

a frame that defines an opening;

a plurality of clamp support segments disposed in the opening;

a plurality of edge connecting members attachable to the frame within the opening having a plurality of connecting ends that are each adapted to be connected to one of the clamp support segments;

a plurality of intermediate connecting members having a plurality of connecting ends, wherein each intermediate connecting member is connected to at least two clamp support segments;

alignment pins mounted to a first end and a second end of the clamp support segments and received by the connecting ends of the connecting members, wherein the connecting ends define a plurality of alignment pin holes;

a clamp disposed on the clamp support segments; and a reinforcement member connecting linearly aligned clamp support segments, at least one connecting member, and the frame within the opening.

8. The fixture of claim 7 wherein the first end and the second end of the clamp support segments define at least two holes spaced relative to one another that extend lengthwise through the clamp support segment.

9. The fixture of claim 7 wherein the connecting members define a first hole that extends in an X-direction and a second hole that extends in a Y-direction, wherein the first hole and the second hole are oriented to cooperate with the clamp support segments and receive the reinforcement member.

* * * * *